US006561370B1

(12) United States Patent
Escobar-Harrity

(10) Patent No.: US 6,561,370 B1
(45) Date of Patent: May 13, 2003

(54) CONTAINER CAP WITH DOUBLE FUNCTION RING

(76) Inventor: Miguel Francisco Escobar-Harrity, 11 de abril No. 8, 01180 Mexico D.F. (MX)

( * ) Notice: Subject to any disclaimer, the term of this patent is extended or adjusted under 35 U.S.C. 154(b) by 51 days.

(21) Appl. No.: 09/680,939

(22) Filed: Oct. 10, 2000

(30) Foreign Application Priority Data

Oct. 7, 1999 (MX) ..... 9909171

(51) Int. Cl.[7] ..... B65D 41/34; B65D 50/08

(52) U.S. Cl. ..... 215/218; 215/219; 215/221; 215/252

(58) Field of Search ..... 215/216, 217, 215/218, 219, 221, 252, 256

(56) References Cited

U.S. PATENT DOCUMENTS 3,967,745 A * 7/1976 Julian ..... 215/216
4,105,132 A * 8/1978 Keeler ..... 215/216
4,471,878 A * 9/1984 Davis et al. ..... 215/216
4,540,098 A * 9/1985 Luker ..... 215/216
4,548,329 A * 10/1985 Curry ..... 215/216
4,630,743 A * 12/1986 Wright ..... 215/216
5,176,270 A * 1/1993 Battagazzore ..... 215/252
6,039,196 A * 3/2000 Ekkert et al. ..... 215/216
6,053,343 A * 4/2000 Krueger ..... 215/252

* cited by examiner

*Primary Examiner*—Nathan J. Newhouse
(74) *Attorney, Agent, or Firm*—Armstrong, Westerman, and Hattori, LLP

(57) ABSTRACT

A cap with a double function ring is provided, which furnishes the features of showing it has been opened and of being child proof. The ring comprises two pieces of the same size joined to the cap. One of the pieces will be released from the cam when opening the container is attempted, the other piece will remain joined to the cap, when the container is being opened, it will be necessary to press two opposite ends of the double function ring, for the purpose of releasing the movement preventing elements.

12 Claims, 4 Drawing Sheets

CONTAINER CAP WITH DOUBLE FUNCTION RING

The present invention relates to a container cap, and more specifically to a double function ring cap to prevent tampering without evidence thereof and to prevent children from reaching its contents.

BACKGROUND AND FIELD OF THE INVENTION

The number of substances that should not be handled by children is growing every day. Such substances, for some tasks being indispensable, certainly are harmful in the hands of children. Examples of these substances are medicines, especially those designated as "controlled", solvents, pesticides and other chemicals, either solid or liquid. It is not redundant to say that many of these substances are commonly found in a home or shop, and in places which are at the reach of children.

The inquisitive nature of children leads them to expose themselves to the peril of finding a container holding a harmful material for them either by inhalation, ingestion or mere touch, with the resulting temporary or permanent damage for the children. To avoid this type of harm a variety of container caps have been developed over time, having a child resistant purpose, this being attained in a higher or lower degree.

Child resistant caps should provide some sort of mechanism that should deter the child to open the cap, either the mechanism requiring a certain force not yet developed by the child, or that its operation requires some intelligence or manual dexterity also not yet developed during childhood.

One type of these inventions uses a cap comprising two parts. There is one internal part coupled to the neck of the bottle and forming the seal. The external part is configured in a way that for unthreading or opening the cap, the user must manipulate the external part in a manner such that this external part locks with the internal part; otherwise, the external part will only turn freely without opening the cap. Generally, the way to lock the external part with the internal part is through pressing down the external part and at the same turning thereof. This is a good option given that the child cannot read the instructions to open the container, nor has the skills to execute this operation.

Such cap as can be seen, comprises two parts, requiring assembly and separate and different machines and/or moulds for production thereof.

Another type of invention for child resistant caps uses a one piece cap, which coacts with one or more teeth or ridge located in the neck or mouth of the container or bottle. Generally these inventions provide a class of gear mechanism which allows the cap to be threaded but deters its threaded in an easy way. To unthread it is necessary to raise a part of the cap consisting of a ring to eliminate the operation of the ratchet formed between this ring and the ridges formed in the neck of the container. In another type of child proof caps, the cap is compressed in two opposite parts thereof, located at the middle of the distance between the ridges preventing the cap opening, deforming the cap to eliminate the blocking imposed by the ridges in the neck of the container.

An important object to which are dedicated many efforts, is to avoid tampering of the containers and thus their contents. To such effect, a series of devices are provided, particularly tamper proof rings, which make evident its opening.

The general operation of these rings showing if a container has been opened, comprises separation of the ring joined to the cap by turning the cap a certain degree. In some cases this turning is very small and in others it allows a little more freedom, but in both cases once over a certain limit, the rings start being separated from the cap by breaking part of the elements that join it to the cap.

There are also caps combining these two functions, that is to show if a container has been opened, and also that are child proof. However, caps of this type comprise two separately moulded pieces in which one of them contains the tamper proof ring, the inner piece, while the other, the outer piece, works together with the inner piece and provides the cap with the feature of being child proof. This type of cap, besides using double moulds and double machinery for their production, requires an assembly or disassembly step of both pieces.

Currently in the market there is a single piece type of cap using a ring with this double function, providing both opening evidence and being child proof.

This cap basically comprises a ring having a series of ridges on its inner periphery which interact with another series of ridges located in the neck of the container matching in diametral pitch, to result in a ratchet action, allowing the free movement of the cap when being closed but preventing any movement when an attempt is made to open it. To be able to unscrew the cap it is necessary to raise the ring almost a hundred percent of its perimeter and release the ridges of the cap from the ridges on the container neck. In order to raise this ring it is necessary to break a series of links between the ring and the cap thus showing in a not very evident way that the cap has been removed from its position.

Therefore, there is the need of a cap which child proof, that shows a clear evidence of opening and further moulded in a single piece, thus avoiding the double moulding of caps and assembly thereof with their corresponding extra expenses.

To the best knowledge of the inventor there is no cap in the market that meets the above described requirements.

SUMMARY OF THE INVENTION

The present invention will be described with reference to a preferred embodiment although from the present description there will be evident modifications that may exist with reference to the subject matter of the present invention without departing from the scope thereof. The present invention basically consists of a cap having adhered thereto a ring in turn comprised by two parts, but moulded in the same piece. These parts can be of the same 20 size in perimeter or can be of different perimeters for example the first part can be of a longer perimeter than the second part, or vice versa.

In fact, the ring comprises two pieces that in the preferred embodiment, are of the same size. One of the parts comprises the elements that will provide the container its tamper resistance and the other will provide the feature of being child proof. The part corresponding to tamper resistance shows a series of ridges or projections and valleys interacting with the corresponding projections and valleys that has the container's neck and matching in pitch therebetween. The projections and valleys in the container are shown in all the neck's periphery, as is known in the art.

The part providing the child proof feature comprises a lower or equal number of ridges than the tamper resistant part, depending on the use of the cap and its dimensions at least one of these ridges is preferred and a maximum being determined by the cap's dimensions, as is evident to anyone skilled in the art.

Likewise the length of the parts will depend mainly on the cap's dimensions and the manufacturing material features.

DESCRIPTION OF A PREFERRED EMBODIMENT OF THE INVENTION

Figure 1:
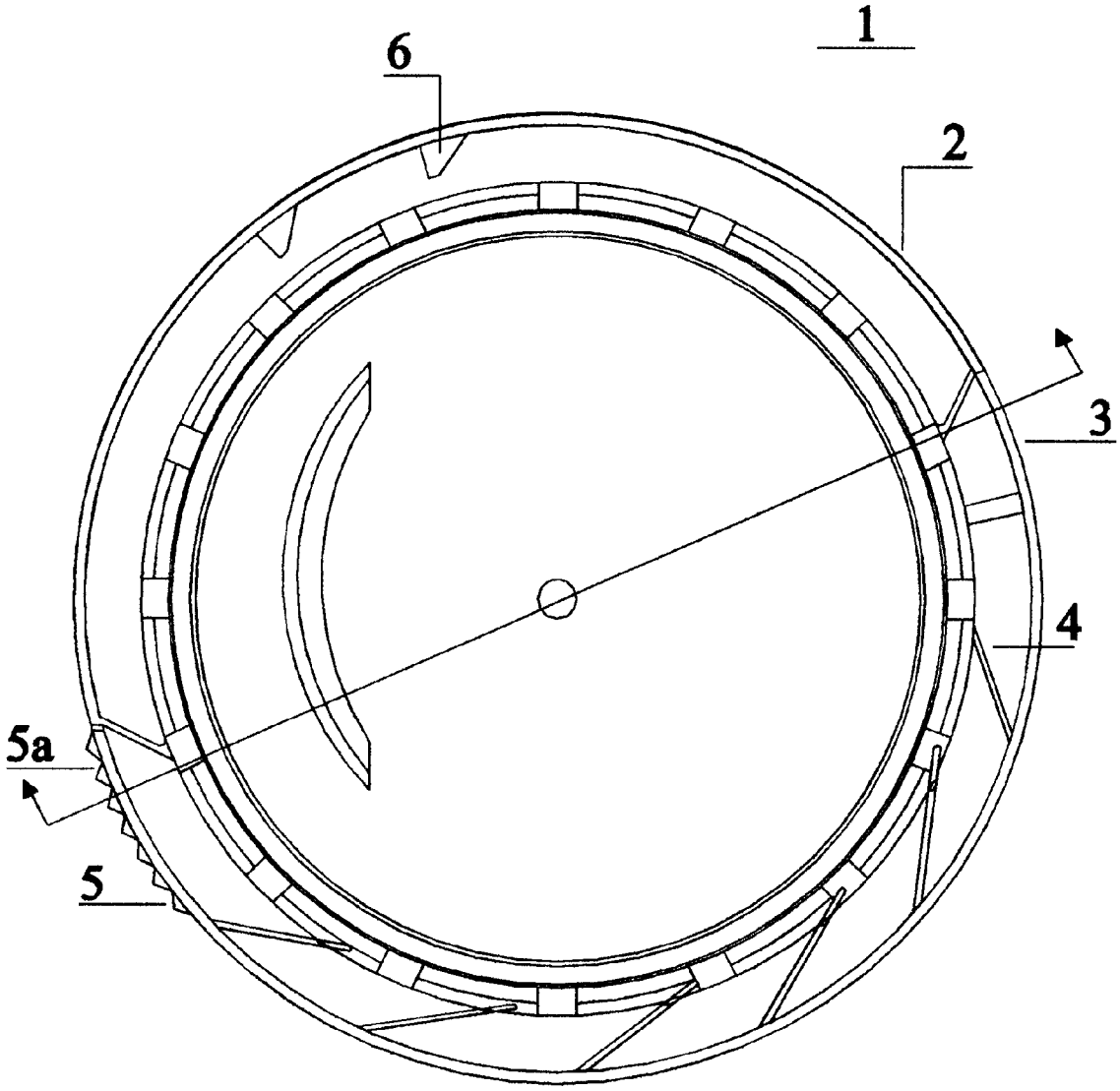
FIG. 1 is a top plan view showing the cap and 20 ring according to the present invention.

With reference to FIGS. 1–5 it is described in a detailed form the cap which is the object of the present invention.

As can be appreciated, the cap 1 object of the present invention basically comprises a body consisting of a fluted external part 7, a threaded internal part 8 on its side walls and of a suitable diameter to couple with the container to which the cap is destined, a ring joined to the cap by means of small bridge elements 4 of the same material, which in turn act as anchoring elements or projections to prevent the cap's movement. The internal part of the cap has an upper part 9 which makes a seal together with the border of the container's mouth being closed. The cap is moulded of a single piece from a resilient and synthetic plastic material and the ring is of a double function.

The double function of the cap consists in providing evidence of the container's opening and being child proof.

The ring is divided in two parts, in the preferred embodiment the perimeter of these parts is equal; however the perimeter of one can be bigger than that of the other regarding the periphery. The first part 3 having a series of projections 4 and valleys between the projections acting as a ratchet by cooperating with the corresponding projections and valleys in the neck of the container which allows that the cap to turn in one direction but preventing the same to turn in an opposite sense once the projections have penetrated the respective portions or valleys of the container.

Figure 2:
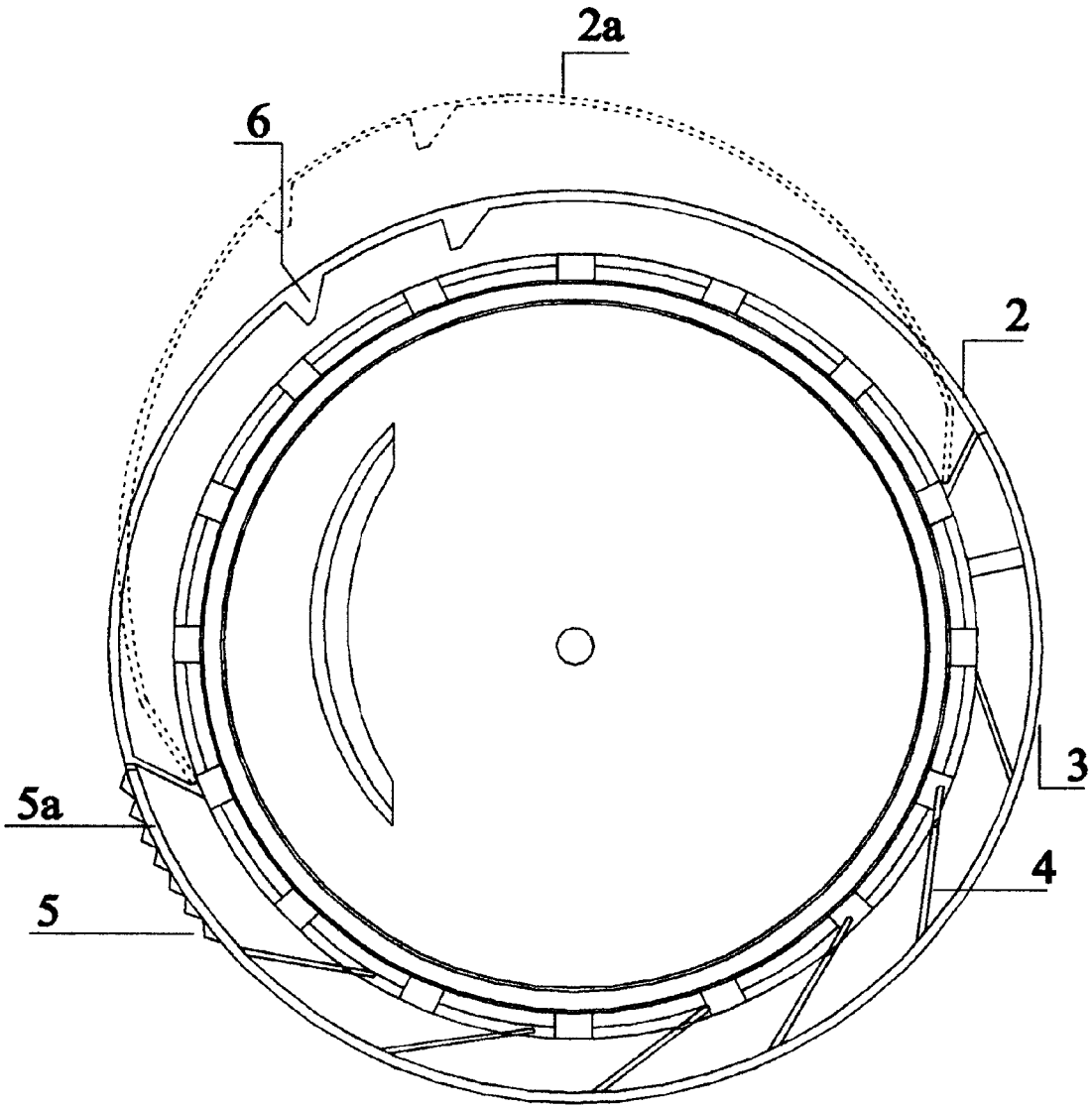
FIG. 2 shows top plant view of the cap with the child proof ring in a deformed position to allow opening of the container.
Figure 3:
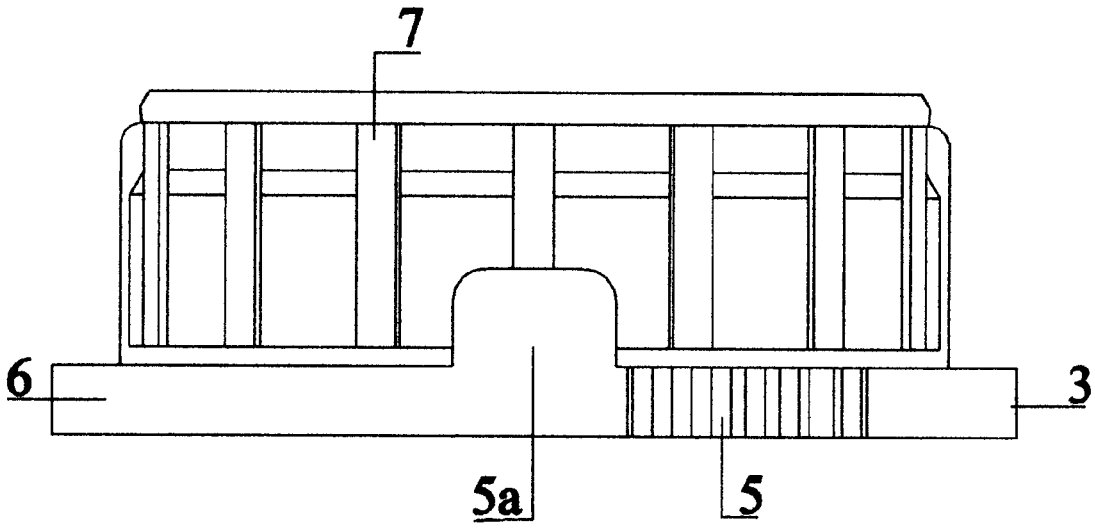
FIG. 3 is a right side elevation view of the cap and its ring.
Figure 4:
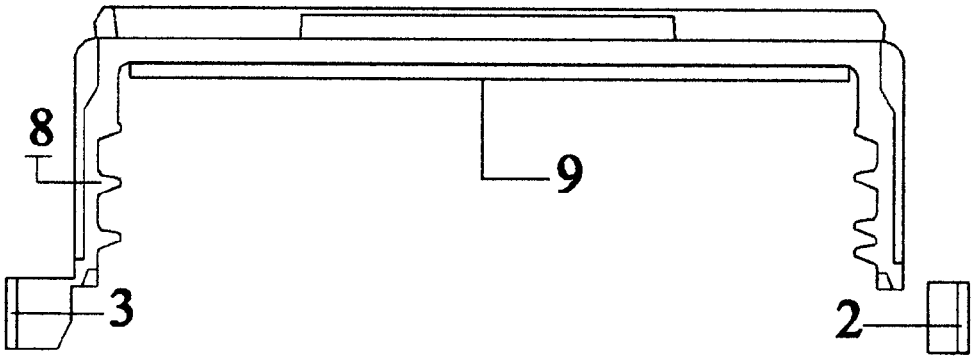
FIG. 4 is a cross section view taking along line A—A of FIG. 1.
Figure 5:
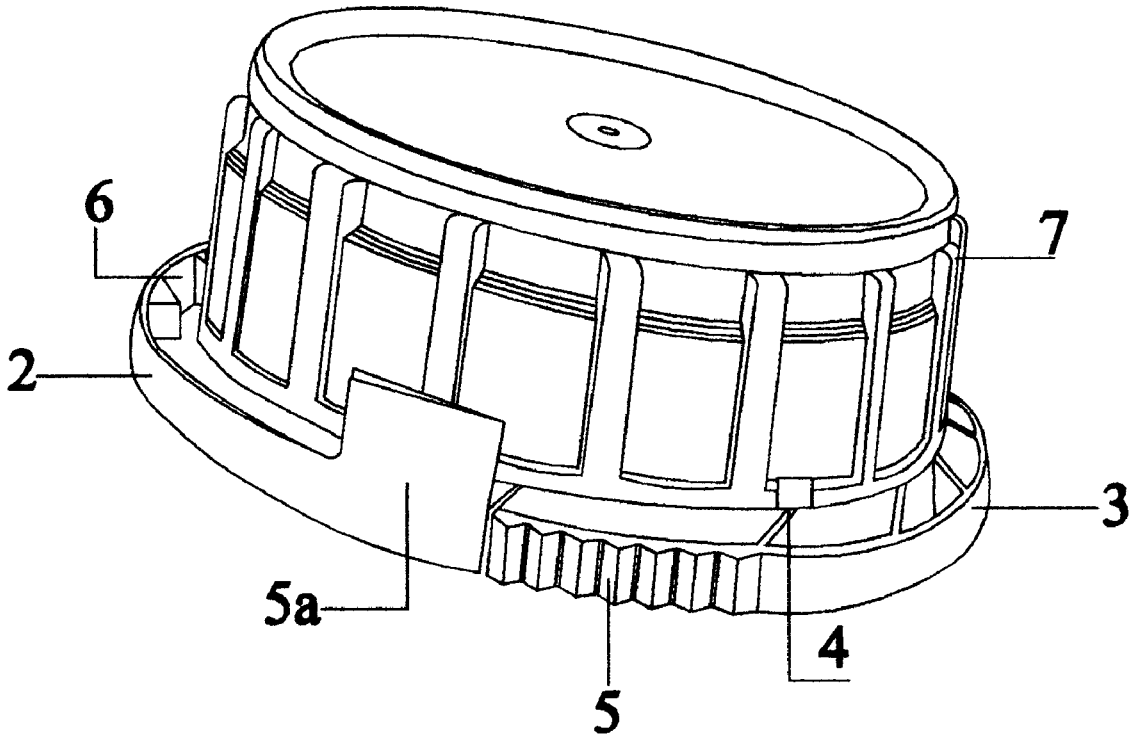
FIG. 5 is a perspective view of the cap of the present invention showing the double function ring.

The second part 2 of the dual ring has projections 6 which are the same or different from those used in the first part and equally interacting with corresponding projections in the neck of the container to prevent the container from being opened without prior handling of this ring. Such handling comprises exerting pressure on two support points preferably located in the ends of the second part of the ring at different positions, FIG. 2, which force this second part to exert pressure near them, making an oval on the side intermediate to the fingers exerting the pressure. In this FIG. 2 is shown the second part of the ring 2 in its normal position and in its deformed position 2*a* when being under pressure as before described.

For clarity, in the drawings the support points have been made to coincide with the ends of the second part, this being the preferred embodiment although not excluding that the support points may be located in any other position.

To open the container, the first part 3 must be partially or completely removed, manually detaching it without turning the cap. One of the ends is enabled to ease this operation. This first part may or may not remain suspended from the cap for the purpose of not allowing this material to be dumped to the floor creating trash.

In a second embodiment the tamper proof ring can be detached from the cap by turning thereof, this can be done by breaking the rings bridge elements 4. Therefore, in this embodiment, elements 5 and 5*a* are not shown.

The next step comprises exerting pressure on the second part of the ring. This pressure must be enough to allow the second part 2 to deform sufficiently to free the projections 6 of the ring from the projections of the containers neck. The support points of the second part are preferably located in the boundaries between this second part and the first, although they can be located in any other position as necessary for the correct liberation of the projections 6.

The cap is made of a sufficiently resilient material to allow that, once the pressure is released, this second part again couples with the container's neck projections without having an apparent deformation.

Once totally or partially detached, the first part 3 of the tamper proof ring cannot be repositioned and the evidence of being opened is clear. It is important to highlight that if this first part of the ring is not detached, it is not possible to open the cap.

To this first part of the ring there can be an edge 5*a* with the purpose to allow its detachment although this is only optional and will depend on the intended use thereof; for example, if the intended use is to open in a shop, the edge can be omitted as the features and the tools available in this places allow its detachment. In turn, if the use is for a home, the edge is of great help. In this sense it can be pointed out that the ease to detach the first part can vary depending again of the use intended for the cap, this first part having a section 5 which presents a series of flanges to allow handling and detachment of the cap.

The second part 2 of the dual or double function ring having inside projections 6 and valleys between these projections, interacting with corresponding projections and valleys in the neck of the container to prevent the container from being opened without prior handling of this ring. This handling comprises exerting pressure on the second half of the ring at opposite positions, preferably near the support points located at the start and finish ends of the second part.

What is claimed is:

1. A child-resistant and tamper evident closure comprised of a ribbed external part, an internal part threaded on its sidewalls and of suitable diameter and pitch to couple to the container to which it is intended to close, a ring joined to the cap, the internal part of the cap having an upper part which forms a seal together with the mouth of the container that is being closed, characterized by the fact that the ring comprises two joined parts, said ring attached to the cap on the first part by a series of frangible connector projections acting as ratchets; while the second part is fixedly, connected to the cap only by at least two ending portions, the first part is removable attached.

2. The cap according to claim 1, characterized in that the second part includes projections which engage corresponding valleys in the neck of the container allowing the cap to turn in one sense but preventing it in the opposite sense once these projections have penetrated said corresponding valleys.

3. The cap according to claim 2, characterized in that the projections of the first part allow the cap to turn in one sense but preventing it in the opposite sense once these projections have penetrated corresponding valleys in the neck of the bottle; in order to unscrew the cap from the container it is necessary pulling off the first part by physically detaching one of its ends.

4. The cap according to claim 3, further characterized in that the second part has at least one projection, which interact with corresponding projections and valleys on the container's neck affecting the same ratchet mechanism on the bottle as with the first part, to release this mechanism, in order to open the cap it is necessary besides pulling off the first part, to exert pressure at specific points of the second part, so the cap can be turned off.

5. The cap according to claim 4, further characterized in that the pressure being exerted on the second part must be enough to provoke the second part to deform enough to release the projections of the ring from the valleys of the container's neck.

6. The cap according to claim 5, further characterized in that support points of the second part are located at each of the ends thereof.

7. The cap according to claim 6, further characterized in that the first and second parts from the perimeter of the ring.

8. The cap according to claim 7, further characterized in that the first part is peripherally longer than the second part.

9.The cap according to claim 8, further characterized in that the cap is built of a sufficiently resilient material to allow that once the pressure is released, the second part will freely couple again with the container's neck preventing the cap from being opened again without the prior described operation.

10. The cap according to claim 7, further characterized in that the second part is peripherally longer than the first part.

11. The cap according to claim 10, further characterized in that the cap is built of a sufficiently resilient material to allow that once the pressure is released, the second part will freely couple again with the container's neck preventing the cap from being opened again without the prior described operation.

12. The cap according to any of the preceding claims, characterized in that the first part has a web at one end to easily remove it.

* * * * *